United States Patent [19]

Hoebing et al.

[11] 4,147,038

[45] Apr. 3, 1979

[54] AUXILIARY COOLING APPARATUS

[76] Inventors: Richard F. Hoebing, 2424 Spruce; Robert L. Ledbetter, 2058 Lind St., both of Quincy, Ill. 62301

[21] Appl. No.: 853,058

[22] Filed: Nov. 21, 1977

[51] Int. Cl.[2] ..... F25D 17/00

[52] U.S. Cl. ..... 62/180; 62/203; 62/332; 62/409; 62/412; 165/16; 236/49

[58] Field of Search ..... 98/33 A, 40 D, 94 AC; 62/180, 203, 332, 409–412, 235; 165/16; 236/49

[56] References Cited

U.S. PATENT DOCUMENTS

| | | | |
|---|---|---|---|
| 1,053,443 | 2/1913 | Scott | 62/235 |
| 2,067,959 | 1/1937 | Wasson | 236/49 |
| 2,299,174 | 10/1942 | Plummer | 98/39 |
| 4,023,947 | 5/1977 | Ferry | 62/180 |

*Primary Examiner*—Ronald C. Capossela
*Attorney, Agent, or Firm*—Bernard L. Kleinke

[57] ABSTRACT

An auxiliary method and apparatus therefor for cooling refrigerated enclosures equipped with a primary refrigerating system, includes an intake opening mounted in fluid communication with a source of cold air and a blower having its inlet connected in fluid communication with the intake opening to draw cold air from the source of cold air, such as cold outside ambient air. The blower is mounted within a heated enclosure to prevent the blower housing from collecting moisture therewithin. A discharge opening is provided in the walls surrounding the refrigerated enclosure and a conduit connects in fluid communication the outlet of the blower and the discharge opening for supplying the cold air to the interior of the refrigerated enclosure when the blower is activated. Thermostats are provided for controlling the turning on and off of the blower, and, in this regard, the auxiliary unit is activated when the temperature of the cold air falls below a predetermined value and when the temperature in the refrigerated enclosure falls below another predetermined temperature below the setting of the thermostat for the primary refrigeration unit. A diverting device is mounted at the discharge opening to direct the cold air away from objects, such as comestibles, within the refrigerated enclosure to prevent them from being damaged by the cold air.

7 Claims, 5 Drawing Figures

MOTOR
TO
Ti

AUXILIARY COOLING APPARATUS

The present invention relates in general to an auxiliary cooling method and apparatus therefor, and more particularly relates to an auxiliary cooling system used for supplying cold air to a refrigerated enclosure to assist in maintaining a cool temperature level therewithin.

In the past, various different types and kinds of auxiliary cooling systems have been suggested. For example, reference may be made to the following U.S. Pat. Nos. 1,053,443; 2,067,959; 2,855,839 and 4,023,947. The auxiliary cooling systems disclosed in the foregoing patents convey cold ambient air to the interior of a refrigerated enclosure, such as walk-in refrigerators and ice skating rinks, for assisting the refrigeration system therefor.

It would be highly desirable to have a new and improved auxiliary cooling system which would be relatively inexpensive to manufacture and which would eliminate, or at least greatly minimize, the collection of moisture within the blower or other such device for transferring the cold air to the interior of the refrigerated enclosure, thereby greatly extending the useful life of the blower. In this regard, if the blower is mounted within the refrigerated enclosure, such as a walk-in refrigerator, moisture from the cold damp air therewithin condenses and collects within the housing of the blower when it is not in use. As a result, when the blower is turned on, water can enter the motor and damage it. If the blower is mounted in the outside air, it is subjected to the prevailing weather conditions, thus shortening its useful life, unless an elaborate or relatively expensive protective arrangement is provided therefor. Also, it would be highly desirable to have a relatively inexpensive and efficient system for having the auxiliary cooling system work in conjunction with the primary refrigeration system so that, when the outside ambient temperature drops below a predetermined value, the auxiliary unit commences operation and the primary refrigeration unit no longer supplies cold air to the interior of the refrigerated enclosure.

Therefore, it is the principal object of the present invention to provide a new and improved auxiliary cooling method and apparatus therefor, which is relatively inexpensive to manufacture and which prevents, or at least greatly reduces, the collection of condensation on the blower or other such cold air transferring device and otherwise protects it.

Another object of the present invention is to provide such a new and improved auxiliary cooling method and apparatus therefor which has a relatively inexpensive and efficient arrangement for preventing the primary refrigeration unit from supplying cold air to the refrigerated enclosure when the auxiliary unit is in operation.

Briefly, the above and further objects of the invention are realized by providing a new and improved auxiliary cooling system, which includes an air intake opening mounted in fluid communication with a source of cold air, such as cold outside ambient air, and a blower device has its inlet connected in fluid communication with the intake opening. The blower device is mounted within a heated enclosure to prevent, or at least greatly minimize, the collection of condensation in the housing of the blower device. A conduit connects in fluid communication the outlet of the blower device and a discharge opening in the refrigerated enclosure walls to supply the cold air to the interior thereof by means of the blower when it is activated. Thermostat devices control the operation of the blower, and in this regard, when the temperature of the ambient outside air falls below a predetermined value, the auxiliary unit operates to maintain the temperature inside the refrigerated enclosure at a temperature below the temperature setting for the thermostatically controlled primary refrigeration unit. As a result, the primary unit remains inactive during the interval of time when the outside temperature is below the predetermined temperature value.

These and other objects of the present invention will become apparent to those skilled in the art by a review of the following detailed description and drawings, wherein.

Figures 1, 2, 3, 4, 5:
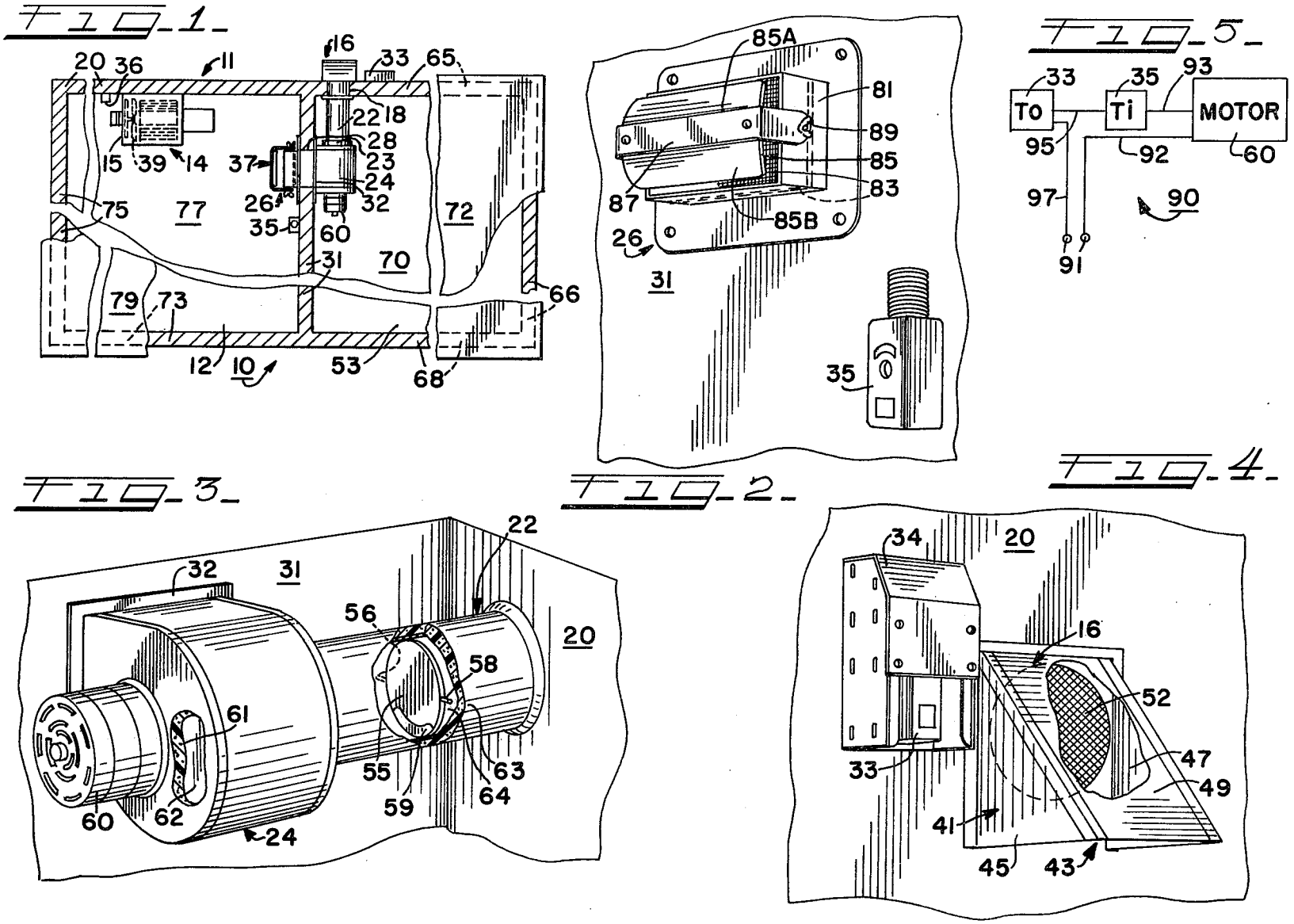
FIG. 1 is a fragmentary cross-sectional plan view of the auxiliary cooling system, which is constructed in accordance with the present invention and which is illustrated mounted in position within a building structure including a refrigerated enclosure.
FIG. 2 is an enlarged fragmentary pictorial view of a portion of the auxiliary cooling system disposed inside the refrigerated enclosure.
FIG. 3 is an enlarged fragmentary pictorial view of the blower portion of the auxiliary cooling system.
FIG. 4 is an enlarged fragmentary pictorial view of a portion of the auxiliary cooling system of FIG. 1 shown mounted on the outside of the building structure in the outside ambient air.
FIG. 5 is a schematic representation of the wiring diagram for the auxiliary cooling system of FIG. 1.

Referring now to the drawings, and particularly to FIG. 1 thereof, there is shown an auxiliary cooling system 10, which is constructed in accordance with the present invention and which is shown mounted within a building structure 11, such as a store, restaurant or the like having a refrigerated enclosure, generally indicated at 12, such as a walk-in refrigerator or freezer room. A primary refrigeration unit 14 includes an evaporator 15 mounted within the enclosure 12 for cooling it. It should be understood that the unit 14 can be either a refrigerator or a freezer unit depending upon the use of the enclosure 12. The auxiliary cooling unit 10 generally comprises an intake port or inlet generally indicated at 16 mounted over an intake opening 18 in an outside wall 20 of the building structure 11 and an insulated conduit or duct 22 connecting in fluid communication the opening 16 with an inlet 23 (FIG. 1) of a blower 24. A discharge port or outlet 26 is mounted within the interior space of the refrigerated enclosure 12 and is connected in fluid communication through an outlet opening 28 in an interior wall 31 of the building structure 11 defining in part the interior space of the refrigerated enclosure 12 to a discharge outlet 32 (FIG. 1) of the blower 26. An outside thermostat 33 having a protective cover 34 is mounted on the outside surface of the outside wall 20 near the inlet 16 in the outside atmosphere to initiate the operation of the auxiliary cooling system 10 when the temperature of the outside ambient air falls below a predetermined value, as hereinafter described in greater detail. An inside thermostat 35 mounted on the inside surface of the interior wall 31, defining in part the interior space of the refrigerated enclosure 12, activates the system 10 when the thermostat 33 calls for cooling and the temperature inside the enclosure 12 falls below a predetermined set temperature. The thermostat 35 is set to call for cooling at a temperature which is 2 degrees F. below the temperature set by a thermostat 36 for the primary refrigeration unit 14. As a result, once the ambient temperature of the outside air falls below a predetermined value, as set by the thermostat 33, the cold ambient air is supplied to the interior of the refrigerated enclosure 12 to maintain it at an inside temperature determined by the setting of the inside thermostat 35, which inside temperature is below the temperature setting of the thermostat 36 for the refrigeration unit 14, whereby the unit 14 does not supply cold air to the interior of the refrigerated enclosure 12, while the auxiliary unit 10 is in operation. As a result, great cost savings in energy consumed by the refrigeration unit 14 are realized, since the blower 24 consumes far less energy than the compressor (not shown) of the primary unit 14.

In order to distribute uniformly the cold air throughout the interior of the enclosure 12, as the cold air enters via the outlet 26, a diverter 37, as hereinafter described in greater detail, diffuses the cold air within the interior of the enclosure 12. Moreover, a fan 39 of the primary refrigeration unit 14 is activated during the entire operation of the auxiliary system 10 so as to move the air within the interior of the enclosure 12. Thus, there is no need for any electrical connections or other connections to the primary refrigeration unit 14 for controlling it, and the relatively low power consumption for operating the fan 39 does not affect adversely to a significant extent the great cost savings realized by employing the auxiliary system 10.

Referring now to FIG. 4 of the drawing, the intake inlet 16 will now be described in greater detail. The air intake 16 includes a hood 41 having a horizontal opening 43 at the bottom portion thereof to permit air to enter and be guided to the intake opening 18 therethrough and to reduce the likelihood of turbulent wind conditions from causing air to blow into the system 10 when the system 10 is inactive. The hood 41 has a pair of triangularly-shaped vertical outwardly projecting side walls 45 and 47 and a rectangularly-shaped, downwardly sloping top wall 49 extending outwardly from the outside wall 20 and interconnecting the side walls and fixed thereto at their adjoining marginal edges. A protective screen 52 is disposed over the intake opening 18 to the conduit 22 on the inside of the hood 16 to prevent foreign matter from entering the conduit 22 to protect the blower 24 and the other parts of the system 10.

Considering now the blower 24 in greater detail in reference to FIG. 3 of the drawing, in accordance with the present invention, a heated enclosure 53 is provided within the building structure 11 outside the refrigerated enclosure 12, the heated enclosure 53 shown in FIG. 1 of the drawings being a heated room adjacent the refrigerated room enclosure 12 with the interior wall 31 being a common wall between the enclosure 12 and 53. It should be understood by those skilled in the art that the heated enclosure of the present invention may also be other forms of enclosures which have heated interior space. By employing a heated room in the building structure 11 heated by a furnace (not shown) or other source of heat, no additional energy is required to heat the enclosure 53. The blower 24 is mounted on the outside of the interior wall 31 within the heated enclosure 53 of the building structure 11 so that condensation does not tend to collect in the housing of the blower 24 and thus tend to damage it, as would otherwise be the case if the blower were mounted within the damp refrigerated enclosure 12. The warm dry air in the heated enclosure 53 keeps the blower 24 dry when it is not in use. Also, the heated enclosure 53 protects the blower 24 from the outside ambient weather conditions.

A damper 55 is mounted within the insulated conduit 22 and normally closes off the conduit 22 from the outside ambient air. In this regard, the damper 55 is in the form of a circular plate and is pivotally attached to the insulated conduit 22 at the inside thereof at its opposite diametrically opposed edges 56 and 58. The conduit 22 is circular in cross section throughout its length and has the damper 55 pivotally mounted therewithin about the horizontal axis of the damper 55. When the blower 24 is turned on, the suction created thereby causes the dampter 55 to pivot about its horizontal mid-point axis to open the interior space of the conduit 22 and thus connect in fluid communication the inlet of the blower 24 with the outside ambient air.

When the blower 24 is deactivated, the damper 55 pivots about its horizontal mid-point to the vertical position as shown in FIG. 3 of the drawing to close off the interior of the conduit 22. For this purpose, a weight 59 fixed to the lower portion of the damper 55 below its pivotal connection with the conduit 22 causes the lower half of the damper 55 to be heavier in weight than the upper portion thereof, thereby causing the damper 55 to assume a vertical conduit-closing disposition transversely of an intermediate portion of the conduit 22.

Considering now the blower construction, the blower 24 includes a motor 60, and an insulated covering 61 over a metal housing 62 for the blower 24 to prevent, or at least greatly reduce, condensation forming on the blower 24 when the cold air is flowing therethrough. Similarly, an insulating sleeve 63 surrounds the metal tube 64 forming the interior of the conduit 22 to prevent condensation from forming thereon as well.

Considering now in greater detail the heated enclosure 53, the heated enclosure 53 is in the form of a room having vertical side walls 65, 66 and 68, and wall 31 and a bottom wall or floor 70. A top wall or ceiling 72 completes the enclosure, and it is to be understood that the top wall 72 may also be the roof. The entrance to the heated enclosure 53 is not shown in the drawings.

Similarly, the refrigerated room enclosure 12 comprises a pair of vertical side wall 73 and 75 as well as the exterior side wall and the interior side wall 31, a bottom wall or floor 70, and a top wall or ceiling or roof 72 completes the enclosure 53. It is understood that the enclosure 12 is a room within the building structure 11 and includes an entrance (not shown). The interior wall 31 is a common wall between the adjacent enclosures 12 and 53, but it is to be understood that the two enclosures need not be adjacent to one another, as it will become apparent to those skilled in the art.

Considering now in greater detail the discharge port or outlet 26 with reference to FIG. 2 of the drawings, the discharge outlet 26 includes a conduit 81 which extends through the outlet opening 28 and which is rectangular in cross section throughout its length. A snap-in filter 83 is disposed within the conduit 81 and is positioned transversely to the flow of cold air through the conduit 81 for the purpose of entrapping foreign particles, which trapping is important where the articles (not shown) stored within the refrigerated enclosure 12 may be food items.

The discharge outlet 26 includes at its outer distal end the diverter 37, which, in turn, includes a rectangular plate 85 spaced from the distal end portion of the conduit 81 transversely to the flow of cold air exiting the conduit 81. The plate 85 includes a pair of reversely or backwardly bent portions 85A and 85B to guide the air exiting the conduit 81 backwardly wall 31. In this regard, the air flows upwardly as well as downwardly back toward the wall 31 to distribute it within the interior space of the refrigerated enclosure 12 and thus away from the items being refrigerated in the enclosure 12. In this regard, the diverter 37 prevents the articles from freezing when the temperature of the outside atmosphere is well below freezing where the enclosure 12 is a walk-in refrigerator.

A U-shaped strip 87 is fixed to the plate 85 and, has its ends attached releasably by means of wing nuts and bolts 89 to the distal end portion of the conduit 81, so that the plate 85 can be adjusted positionally to guide the cold air in various different desired directions away from the articles disposed within the refrigerated enclosure 12. In this regard, by loosening the wing nuts, the U-shaped strip 87 can pivot about an axis extending through the wing nuts and bolts 89, either upwardly or downwardly to a desired adjusted position.

Considering now the thermostatic controls for the auxiliary system 10, with particular reference to FIG. 5 of the drawings, there is shown a control arrangement 90, which includes a pair of terminals 91 which are adapted to be connected to a suitable source of electrical potential. An electrical conductor 92 interconnects one of the terminals 91 to the motor 60 of the blower 24 and an electrical conductor 93 interconnects the other terminal of the motor 60 to the inside thermostat 35. An electrical conductor 95 interconnects the inside thermometer 35 and the outside thermometer 33 in series with one another. An electrical conductor 97 completes the series connection between the motor 60 and the thermostats 33 and 35 back to the other one of the terminals 91. As a result, when the outside thermometer 33 calls for cooling, the circuit is prepared for energizing the motor 60, and, when the inside thermometer 35 calls for cooling, the circuit is completed through the thermostats 33 and 35 to the motor 60 to energize it via the terminals 91 to the source of electrical energy (not shown). Thus, the inside thermostat 35 maintains the temperature within the refrigerated enclosure 12 at a certain predetermined value, which predetermined value is substantially lower than the preset temperature for the thermostat 36 for the primary refrigeration unit 14. As a result, when the auxiliary unit 10 is activated to supply cold outside air to the interior of the refrigeration unit 12, the primary refrigeration unit 14 remains inactive except for its fan 39 which distributes the air entering the refrigerated enclosure 12 via the discharge outlet 26 throughout the interior enclosure 12.

When the temperature of the outside air rises above the predetermined temperature determined by the outside thermostat 33, the thermostat 33 opens the circuit to the motor 60 and the primary refrigeration unit 14 resumes control over the retaining of the temperature level within the refrigerated enclosure 12. It will be readily apparent to those skilled in the art that the present invention provides a novel and useful improvement in auxiliary cooling methods and apparatus therefor of the character described herein. The arrangement and types of structural components utilized within the invention may be subject to numerous modifications well within the purview of this invention. It will become apparent to those skilled in the art that various different modifications may be employed. For example, instead of positioning the intake inlet 16 in fluid communication with the outside atmosphere, the intake inlet 16 may be positioned in fluid communication with the interior of a freezer (not shown) to supply the cold air to the interior of the enclosure 12 which may be a refrigerator operating at temperatures above the freezing point. Thus, it is intended only to be limited to a liberal interpretation of the specification and appended claims.

What is claimed is:

1. In an arrangement for cooling a refrigerated enclosure surrounded by top, bottom and side walls and cooled by a primary thermostatically controlled refrigeration system, an auxiliary cooling system comprising:
   - a warm, heated enclosure including top, bottom and side walls;
   - blower means mounted within said heated enclosure and having an inlet and an outlet;
   - means defining an inlet opening in the walls of said heated enclosure;
   - inlet conduit means connecting in fluid communication with inlet opening and said inlet of said blower means;
   - intake means connecting in fluid communication said inlet opening and a source of cold air;
   - means defining an outlet opening in the walls of said heated enclosure;
   - outlet conduit means connecting in fluid communication said outlet opening and said outlet of said blower means;
   - discharge means connecting in fluid communication said outlet opening and the interior of the refrigerated enclosure; and
   - thermostatic means for controlling the turning on and off of said blower means.

2. A combination according to claim 1, wherein the primary refrigeration system includes a thermostat set to turn on the primary system to maintain a predetermined temperature of the air within the refrigerated enclosure, said thermostatic means including an outside thermostat responsive to the temperature of the cold air decreasing below a predetermined temperature to initiate the operation of said auxiliary cooling system, and an inside thermostat responsive to said outside thermostat and responsive to the temperature of the air within the refrigerated enclosure for controlling said blower means to maintain the temperature of the air within the refrigerated enclosure substantially below said predetermined temperature to render the primary refrigeration system inactive.

3. A combination according to claim 1, wherein said discharge outlet includes a diverter for guiding said cold air reversely backwardly to disperse said cold air.

4. A combination according to claim 1, wherein said discharge outlet includes a discharge conduit, and said diverter includes a U-shaped strip adjustably attached to said discharge conduit over the distal end thereof, and a plate having reversely backwardly bent portions disposed transversely to the flow of cold air flowing out of said discharge conduit.

5. A combination according to claim 1, further including an insulated covering disposed over said blower means for retarding the formation of condensation thereon.

6. A combination according to claim 1, wherein said inlet conduit means includes a rigid metal conduit and an insulating sleeve disposed over said inlet conduit.

7. A combination according to claim 1, wherein said intake means includes a hood having a horizontal opening, said hood having a pair of vertical side walls and a downwardly sloping top wall, a screen disposed within said inlet conduit, a damper disposed within said inlet conduit and pivotally attached thereto about its horizontal mid-plane axis, a weight connected to the lower portion of the damper to cause it to assume a vertical disposition when said blower means is deactivated, a filter disposed within said outlet conduit means, said thermostatic means including an outside thermostat, and a protective cover for said outside thermostat.

* * * * *